US006759582B2

(12) United States Patent
Rouston

(10) Patent No.: US 6,759,582 B2
(45) Date of Patent: Jul. 6, 2004

(54) COVER FOR A MUSICAL INSTRUMENT

(76) Inventor: Ian Colin Rouston, Ease Trading, Higher Birks, Crossley New Road, Todmorden, Lancashire OL14 8RP (GB)

( * ) Notice: Subject to any disclaimer, the term of this patent is extended or adjusted under 35 U.S.C. 154(b) by 0 days.

(21) Appl. No.: 10/143,520

(22) Filed: May 10, 2002

(65) Prior Publication Data

US 2002/0166435 A1 Nov. 14, 2002

(30) Foreign Application Priority Data

May 12, 2001 (GB) ..... 0111635

(51) Int. Cl.[7] ..... G10D 13/02
(52) U.S. Cl. ..... 84/421; 84/329
(58) Field of Search ..... 84/421, 411 U, 84/411 P, 416, 329, 327, 379, 385 A, 352

(56) References Cited

U.S. PATENT DOCUMENTS 4,674,630 A * 6/1987 Kirck ..... 206/205
6,025,549 A * 2/2000 Harris ..... 84/411 R

FOREIGN PATENT DOCUMENTS

| | | |
|---|---|---|
| EP | 914813 A | 12/1999 |
| WO | WO 97/27483 A | 7/1999 |

* cited by examiner

*Primary Examiner*—Kimberly Lockett
(74) *Attorney, Agent, or Firm*—Harrison & Egbert

(57) ABSTRACT

A cover for a musical instrument, especially but not exclusively a drum, includes a portion formed by inner and outer sheets fastened together to define a pocket that is padded with a desiccating material. Preferably, the inner and outer sheets are quilted to define a plurality of pockets, each of which is tightly stuffed with a granular form of desiccating material. In this way, the cover provides protection for the instrument and also assists in keeping the instrument in tune by removing moisture from air trapped between the instrument and the portion defining the pockets.

11 Claims, 1 Drawing Sheet

COVER FOR A MUSICAL INSTRUMENT

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to a cover for a musical instrument, especially but not exclusively a drum.

BACKGROUND OF THE INVENTION

One problem encountered with skinned musical percussion instruments such as drums is that, after a period of time, the skin of the drum becomes baggy, altering the musical tone of the instrument by giving it a flatter sound. This occurs because the skin takes up moisture from the air, allowing it to stretch.

Conventionally, the drum is then tuned by tensioning the skin, usually back to the tension it had when it was first manufactured. On animal skin drums, this is usually done by increasing the tension of a rope that secures the skin to the main body of the drum by weaving the rope in and out around the circumference of the drum and hammering down two metal rings to which the rope is fastened. There are, however, several problems with this method of tuning, as follows.

1. It is a job that requires a great deal of human strength and is very time consuming.

2. If the skin is nicked while hammering down the metal rings, it can easily split which requires the drum to be re-skinned.

3. Weaving of the fastening rope can only extend so far up the side of the drum, usually no more than three or four revolutions around the drum, thus preventing further tuning.

4. As the skin is likely to contain excessive moisture, it tends to tear more easily during the tensioning process because the structure of the skin is weakened by the dampness.

BRIEF SUMMARY OF THE INVENTION

The object of the present invention is to provide a cover for a musical instrument which overcomes or substantially mitigates the aforementioned problem.

According to a first aspect of the present invention there is provided a cover for a musical instrument comprising a portion formed by inner and outer sheets fastened together to define a pocket that is padded with a desiccating material.

Hence, such a cover provides protection for the instrument and also assists in keeping the instrument in tune by removing moisture from air trapped between the instrument and the portion defining the pocket.

Preferably, the inner and outer sheets are quilted to define a plurality of pockets.

Preferably also, the desiccating material has a granular form.

Preferably also, each of the pockets is tightly stuffed with the desiccating material. Advantageously, the granules of desiccating material are packed so that they lie at least two deep substantially throughout each of the pockets.

Preferably also, at least one of the inner and the outer sheets is stretchable. This enables the sheet to accommodate slight relative movement of the desiccating granules to absorb impacts and therefore protect the underlying instrument.

Preferably also, the inner sheet, which is intended to lie directly adjacent the musical instrument, comprises a porous layer.

Preferably also, the outer sheet comprises a moisture resistant material.

Preferably also, the inner sheet has a black exposed surface.

Advantageously, the desiccating material comprises a granular silica gel.

Preferably also, the cover is shaped to fit over the musical instrument so that the pocket can lie directly adjacent that portion of the instrument which must be tuned.

Advantageously, the cover comprises a closable bag in which a musical instrument can be located for transportation.

According to a second aspect of the present invention there is provided a cover for a drum comprising a circular portion adapted to lie adjacent a skin of the drum and formed by inner and outer sheets fastened together to define a pocket that is padded with a desiccating material.

Preferably, the circular portion is provided with a peripheral skirt which fits around the cylindrical sides of the drum.

BRIEF DESCRIPTION OF THE SEVERAL VIEWS OF THE DRAWINGS

An example of the present invention will now be described with reference to the accompanying drawings.

DETAILED DESCRIPTION OF THE INVENTION

Figure 1:
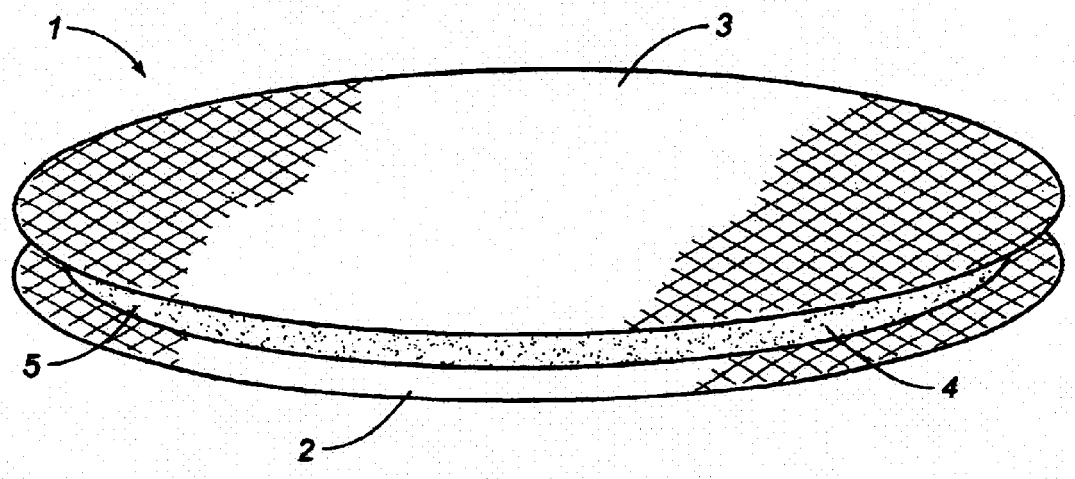
FIG. 1 is an exploded perspective view of a cover according to the present invention.

A cover 1 as shown in FIG. 1 comprises inner and outer sheets, 2 and 3 respectively, which are fastened together to define a pocket 4 that is filled with a desiccating material 5. The sheets 2 and 3 are preferably stitched together but could be secured by adhesive or welding. The desiccating material 5 is preferably a granular silica gel but any suitable material could be used. Advantageously, however, the material 5 has a granular form enabling the pocket 4 to be tightly stuffed, preferably so that the granules lie at least two deep substantially throughout each of the pockets. Preferably also, either or both of the inner and outer sheets 2 and 3 are stretchable. This enables the cover 1 to accommodate slight relative movement of the desiccating granules within the pocket 4 in order to absorb impacts. The pocket 4 therefore functions as a protective cushion for the region of the musical instrument against which it is intended to lie. Also, the more desiccating material 5 that can be held in close contact with the instrument, the more moisture can be removed from the air trapped between the cover 1 and the instrument. In the case of a skin of a drum, this assists in keeping the instrument in tune.

Figure 2:
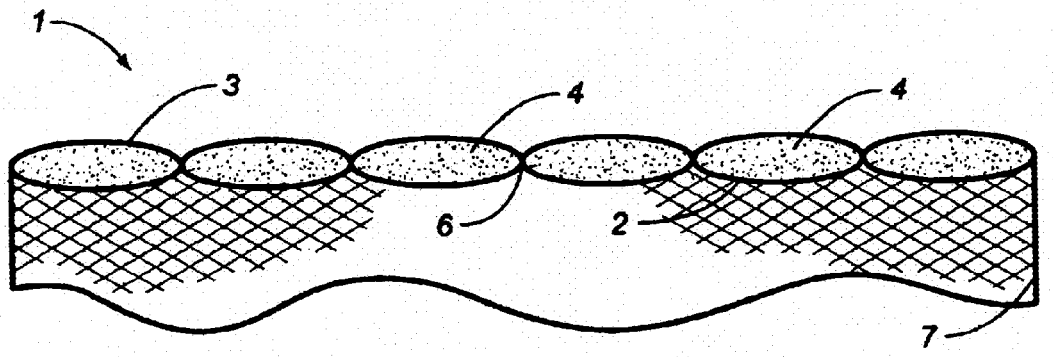
FIG. 2 is a cross-sectional view of a cover according to 35 the invention adapted for use with a drum.

Preferably, as shown in FIG. 2, the inner and outer sheets 2 and 3 of the cover 1 are quilted by the provision of seams 6 to define a plurality of pockets 4, which contain the material 5 and reduce the quantity required to provide an adequate cushion for the instrument, assuming each of the pockets 4 to be tightly stuffed with the material 5.

In order to increase the efficiency of the cover 1, the inner sheet 2, which is that which is intended to lie directly adjacent the musical instrument, comprises a porous fabric, such as cotton or similar. This assists in the passage of moisture from air trapped between the instrument and the cover into the pockets 4. In contrast, the outer sheet 3 preferably comprises moisture resistant material such as nylon, plastic sheeting or a plastic-coated woven fabric. This prevents moisture from penetrating into the pockets 4 from the exterior of the cover 1, which would waste the desiccating properties of the material 5.

From time to time, the material 5 within the cover 1 will need to be refreshed by being dried out. Typically, this can be accomplished by heating the cover, for example by placing it in an oven on a very low temperature for a predetermined period such as overnight. To assist with the drying out of the cover 1, preferably the inner sheet 2 has a black exposed surface so that it absorbs the heat more quickly.

The cover 1 is preferably shaped to fit over at least a part of the musical instrument for which it has been constructed so that the pocket 4 can lie directly adjacent that portion of the instrument which must be tuned. For example, as shown in FIG. 2, if for use with a drum the cover 1 comprises a circular portion defining the pockets 4 that has a diameter slightly larger than the diameter of the skin of the drum. The quilted portion 4 therefore also provides a desiccating protective cushion over the skin. A peripheral depending skirt 7 that can fit around the cylindrical sides of the drum is attached to the circular portion 4 and can be made with a width appropriate for the size of the drum. A drawstring can also be attached around the rim of the skirt 7 so that the cover can be drawn tight around the drum.

One further lateral application of the cover when used on a drum is to produce a musical effect in its own right. It has been found that striking the top of the cover with a drumstick when it is in place over a drum produces a sound similar to a shaker as the granules within the pockets are rubbed together slightly on impact and the sound is magnified within the body of the drum. Hence, the cover can be used in conjunction with a drum in place of a conventional shaker, which can be convenient for the musician.

For other musical instruments, the cover 1 may be made in the front of a closable bag in which a musical instrument can be located for transportation. Preferably, the bag can be zipped closed and is shaped to follow closely the contours of the instrument in order that the efficiency of the desiccating material 5 can be made maximized.

I claim:

1. A cover for a musical instrument comprising;

an inner sheet; and an outer sheet fastened to said inner sheet so as to define a pocket therebetween, said pocket being padded with a desiccating material of granular form.

2. The cover of claim 1, said inner sheet and said outer sheet being fastened together by sewing so as to define a plurality of pockets.

3. The cover of claim 2, each of said plurality of pockets being tightly stuffed with said desiccating material.

4. The cover of claim 1, wherein at least one of said inner sheet and said outer sheet is stretchable.

5. The cover of claim 1, said inner sheet having a porous layer.

6. The cover of claim 1, said outer sheet being of a moisture resistant material.

7. The cover of claim 1, said inner sheet having an exposed surface of black color.

8. The cover of claim 1, said desiccating material being of a granular silica gel.

9. The cover of claim 1, said inner sheet and said outer sheet being shaped so as to fit over the musical instrument.

10. A cover for a skin of a drum comprising;

an inner sheet; and an outer sheet fastened to said inner sheet so as to define a pocket therebetween, said pocket being padded with a desiccating material of granular form, said inner sheet and said outer sheet being of a circular shape suitable for lying adjacent the skin of the drum.

11. The cover of claim 10, said inner sheet and said outer sheet having a skirt extending around a periphery thereof.

* * * * *